US009675835B1

(12) United States Patent
Abramovich

(10) Patent No.: US 9,675,835 B1
(45) Date of Patent: Jun. 13, 2017

(54) PAIRED EXERCISE APPARATUS WITH VARIABLE ELASTIC TENSIONS

(71) Applicant: Shlomo Abramovich, Moshav Migdal (IL)

(72) Inventor: Shlomo Abramovich, Moshav Migdal (IL)

( * ) Notice: Subject to any disclaimer, the term of this patent is extended or adjusted under 35 U.S.C. 154(b) by 0 days.

(21) Appl. No.: 14/953,452

(22) Filed: Nov. 30, 2015

(51) Int. Cl.
*A63B 21/055* (2006.01)
*A63B 21/00* (2006.01)

(52) U.S. Cl.
CPC ..... *A63B 21/0555* (2013.01); *A63B 21/0557* (2013.01); *A63B 21/4033* (2015.10)

(58) Field of Classification Search
CPC ..... A63B 21/4035; A63B 21/0552; A63B 21/0557; A63B 21/00043; A63B 21/0442; A63B 21/055; A63B 21/4043; A63B 21/0555; A63B 21/00061; A63B 21/00065; A63B 21/00069; A63B 21/0428; A63B 23/12; A63B 21/02; A63B 2210/50; A63B 23/03541; A63B 23/0355; A63B 21/00185; A63B 21/4025; A63B 21/4033; A63B 2225/09; A63B 23/1209; A63B 23/03508; A63B 21/05; A63B 21/068; A63B 21/151; A63B 2023/006; A63B 21/04; A63B 21/4015; A63B 21/4023; A63B 21/16; A63B 21/4019; A63B 21/028; A63B 21/4011; A63B 21/1645; A63B 5/00; A63B 21/0407
USPC ..... 482/121, 126; 2/338
See application file for complete search history.

(56) References Cited

U.S. PATENT DOCUMENTS

| | | | | |
|---|---|---|---|---|
| 4,733,862 | A | 3/1988 | Miller | |
| 6,036,626 | A | 3/2000 | Taylor | |
| 7,044,896 | B2 | 5/2006 | Hetrick | |
| 7,892,157 | B2 | 2/2011 | Arnett | |
| 8,684,894 | B2 * | 4/2014 | Flynn | A63B 21/0004 482/121 |
| 9,005,090 | B2 * | 4/2015 | Latronica | A63B 21/0442 482/121 |
| 2004/0157710 | A1 * | 8/2004 | Basting | A63B 21/0004 482/126 |
| 2007/0173383 | A1 | 7/2007 | Freigenbaum et al. | |
| 2012/0329618 | A1 * | 12/2012 | White | A63B 21/0552 482/126 |
| 2012/0329620 | A1 | 12/2012 | White et al. | |
| 2013/0196831 | A1 | 8/2013 | Kinsbourne et al. | |
| 2014/0024508 | A1 | 1/2014 | Hinds | |
| 2015/0151155 | A1 * | 6/2015 | Demarco | A63B 1/00 482/43 |

* cited by examiner

*Primary Examiner* — Andrew S Lo
(74) *Attorney, Agent, or Firm* — Soroker Agmon Nordman

(57) ABSTRACT

An exercising apparatus, comprising a pair of elastic straps correspondingly having lengths, and a pair of buckles correspondingly mounted on the pair of the elastic straps, where each of the buckles having a frame with a passage for each of the elastic straps and oppositely directed flanges and an appendage connect and inclined to the frame on which a first longitudinal end of each of the elastic straps is attached thus compelling each of the elastic straps to form S shape over and in each of the buckles, consequently longitudinally partitioning each of the elastic straps by sliding each of the buckles along each of the elastic straps to releasably fasten each of the buckles on each of the elastic straps.

11 Claims, 5 Drawing Sheets

PAIRED EXERCISE APPARATUS WITH VARIABLE ELASTIC TENSIONS

BACKGROUND

The present disclosure generally relates to an exercise apparatus, and more specifically to a personal exercise apparatus having dually paired parts.

Various devices for personal exercise have been demonstrated in the art, some exemplary ones are reported in the following publications:

U.S. Pat. No. 6,036,626 entitled 'Adjustable resistance exercise device';

U.S. Pat. No. 7,892,157 entitled 'Exercise apparatus and method';

US2012/329620 entitled 'EXERCISE APPARATUS';

US2007/173383 entitled 'Portable exercise apparatus';

U.S. Pat. No. 4,733,862 entitled 'Elastic resistance exerciser';

US2013/196831 entitled 'DOOR-FRAME MOUNTED EXERCISE STRAP';

U.S. Pat. No. 7,044,896 entitled 'Exercise device including adjustable, inelastic straps'; and US2014/024508 entitled 'EXERCISE DEVICE WITH ELASTIC MEMBERS AND WEBBING'.

SUMMARY

One exemplary embodiment of the disclosed subject matter is an exercising apparatus, comprising a pair of elastic straps correspondingly having lengths, and a pair of buckles correspondingly mounted on the pair of the elastic straps, where each of the buckles having a frame with a passage for each of the elastic straps and oppositely directed flanges and an appendage connect and inclined to the frame on which a first longitudinal end of each of the elastic straps is attached thus compelling each of the elastic straps to form S shape over and in each of the buckles (e.g. when the elastic strap is inserted into a buckle), consequently longitudinally partitioning each of the elastic straps by sliding each of the buckles along each of the elastic straps to releasably fasten each of the buckles on each of the elastic straps.

In some embodiments, the apparatus further comprises a pair of safety members correspondingly linked to the pair of the elastic straps at a second longitudinal end of each of the elastic straps, and constructed for a gradual tearing responsive a pressure above a sufficiently high pressure.

BRIEF DESCRIPTION OF THE DRAWINGS

Some non-limiting exemplary embodiments or features of the disclosed subject matter are illustrated in the following drawings.

Identical or duplicate or equivalent or similar structures, elements, or parts that appear in one or more drawings are generally labeled with the same reference numeral, and may not be repeatedly labeled and/or described.

Figure 1A:
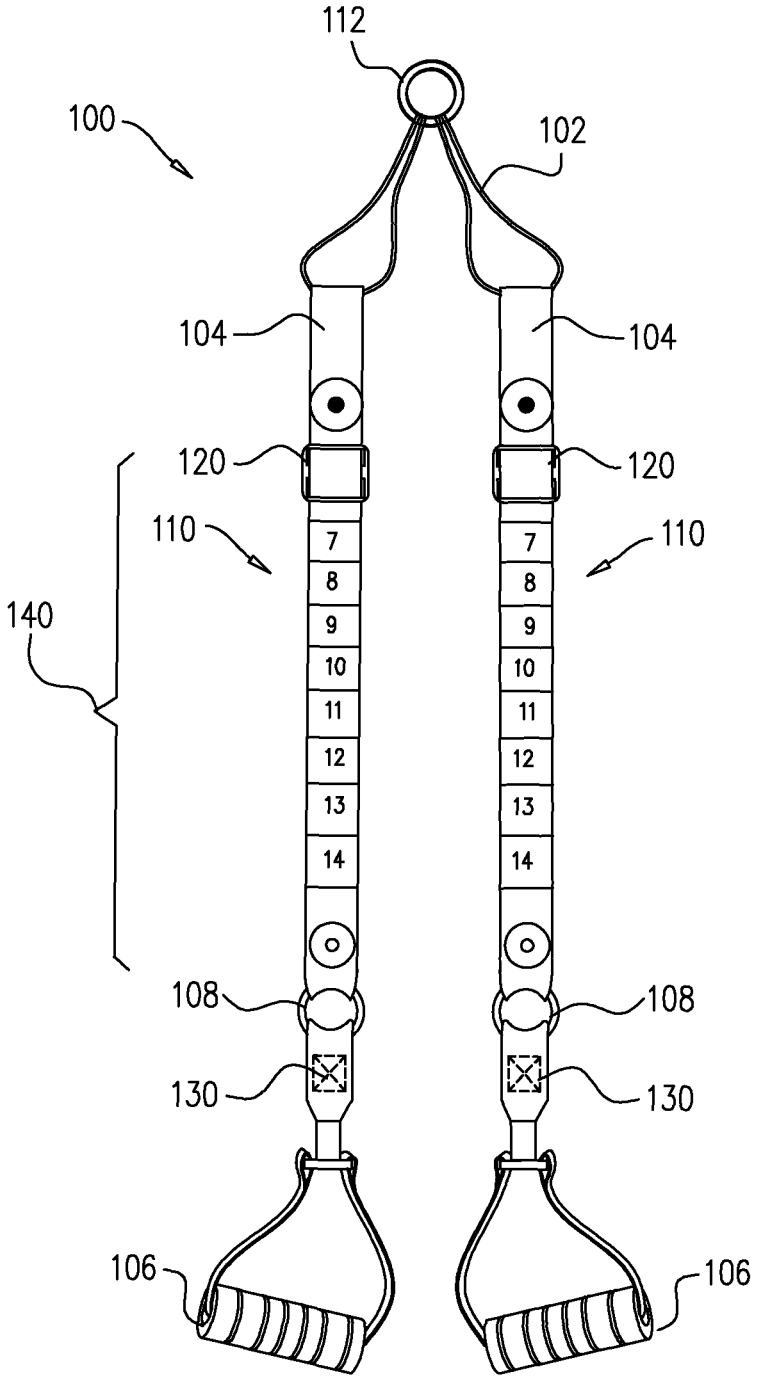

Dimensions of components and features shown in the figures are chosen for convenience or clarity of presentation and are not necessarily shown to scale or proper perspective. For convenience or clarity, some elements or structures are not shown or shown partially only and/or with different perspective and/or from different points of views.

References to previously presented elements are implied without necessarily further citing the drawing or description in which they appear.

Figure 1B:
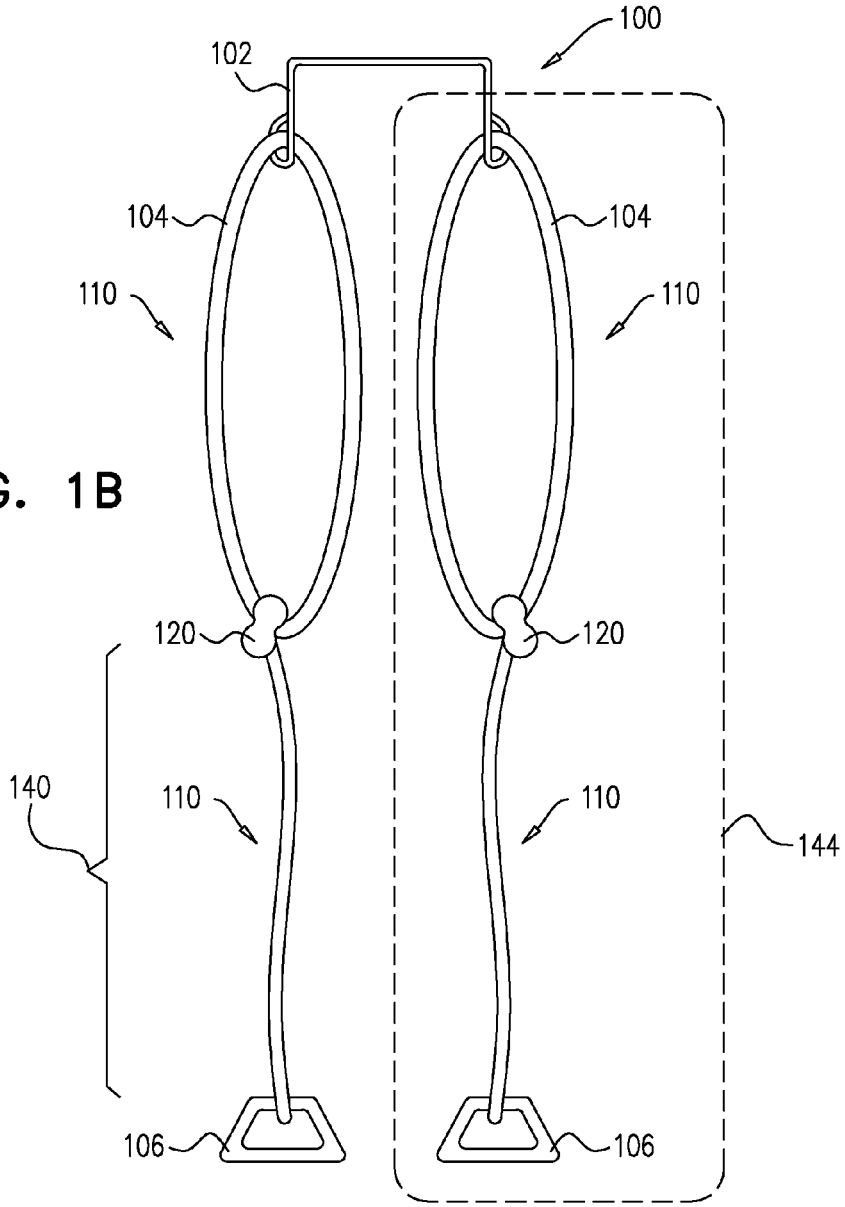
Figure 1C:
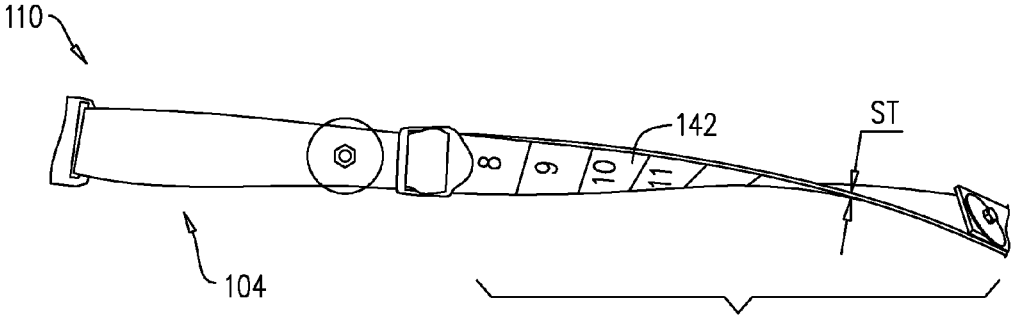
Figure 2A:
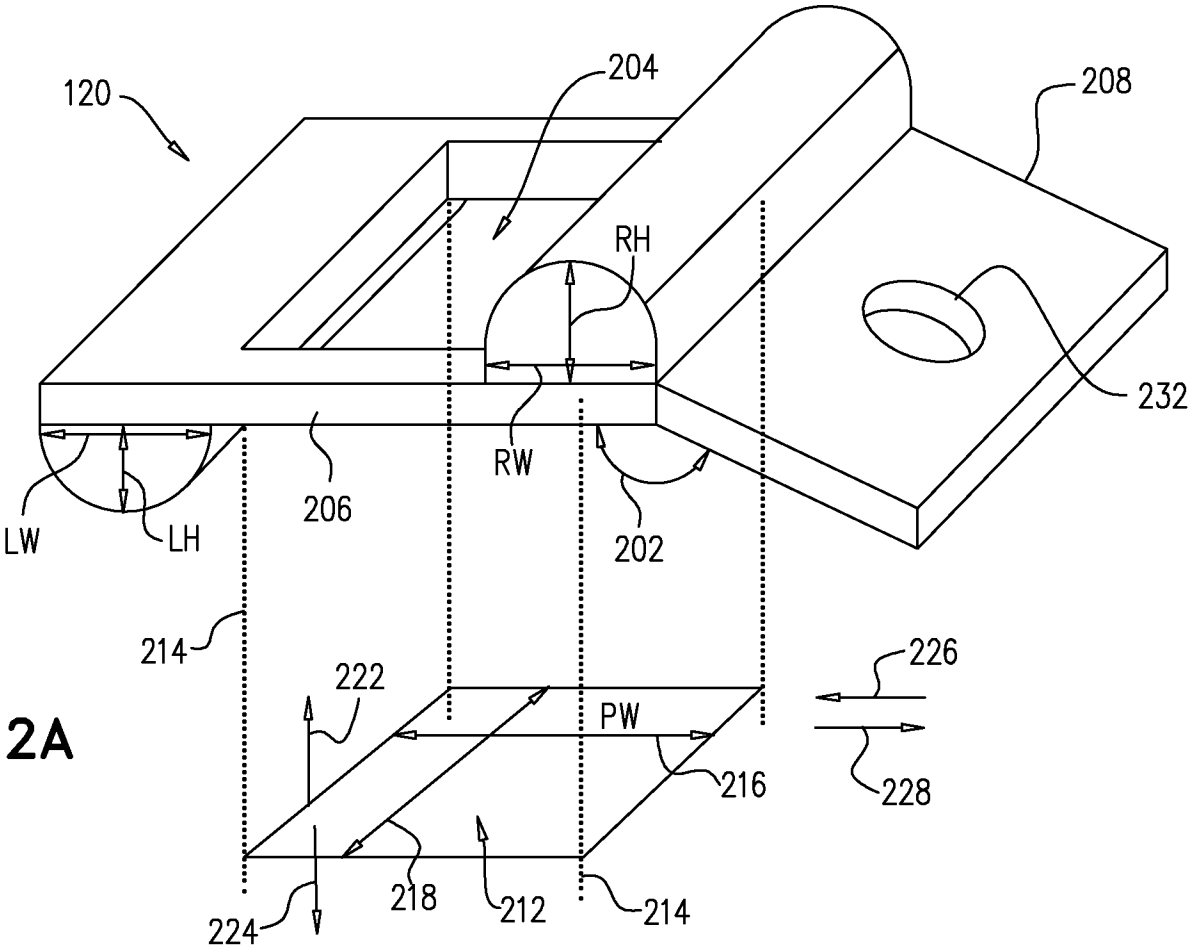
Figure 2B:
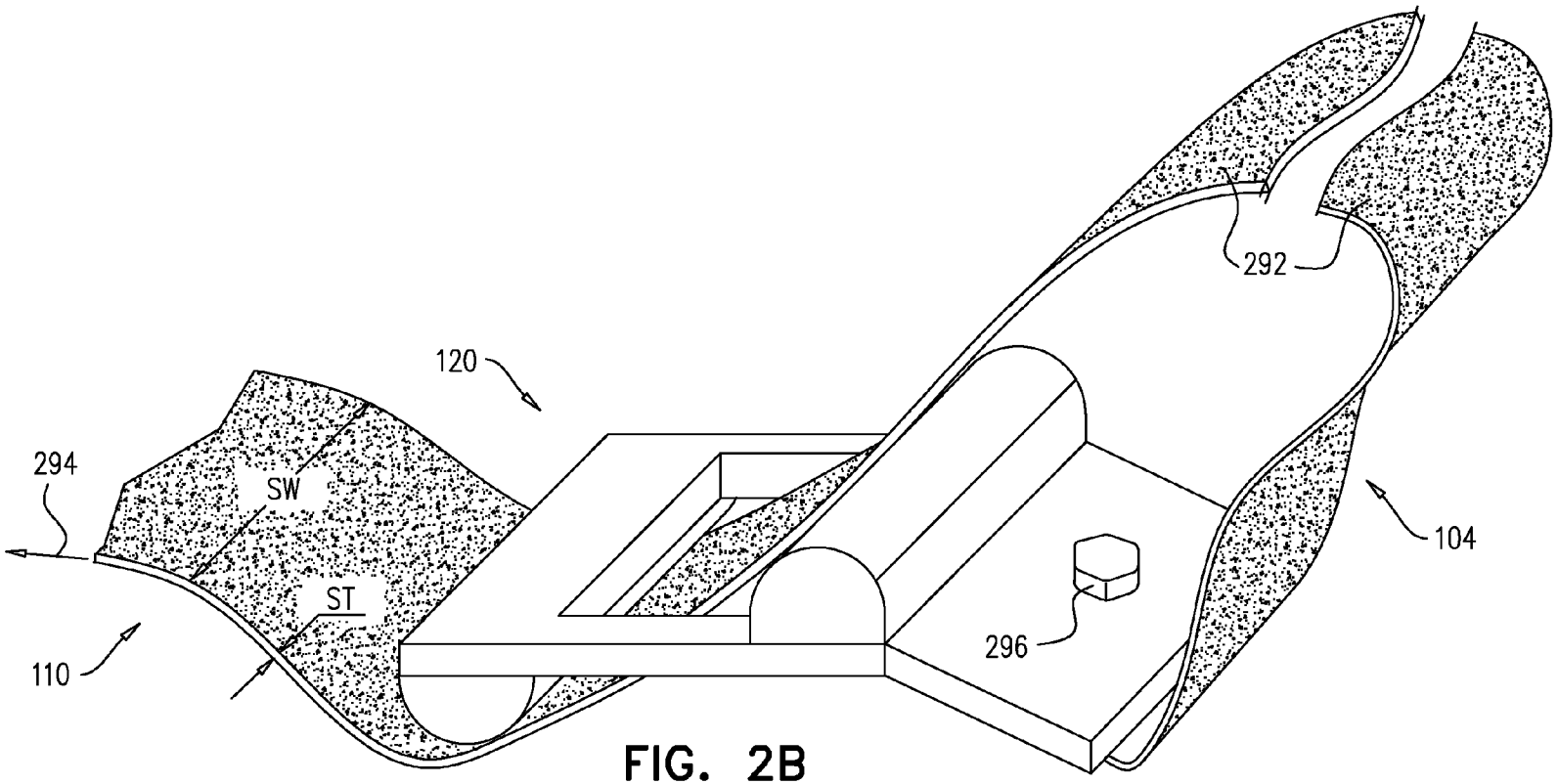
Figure 3:
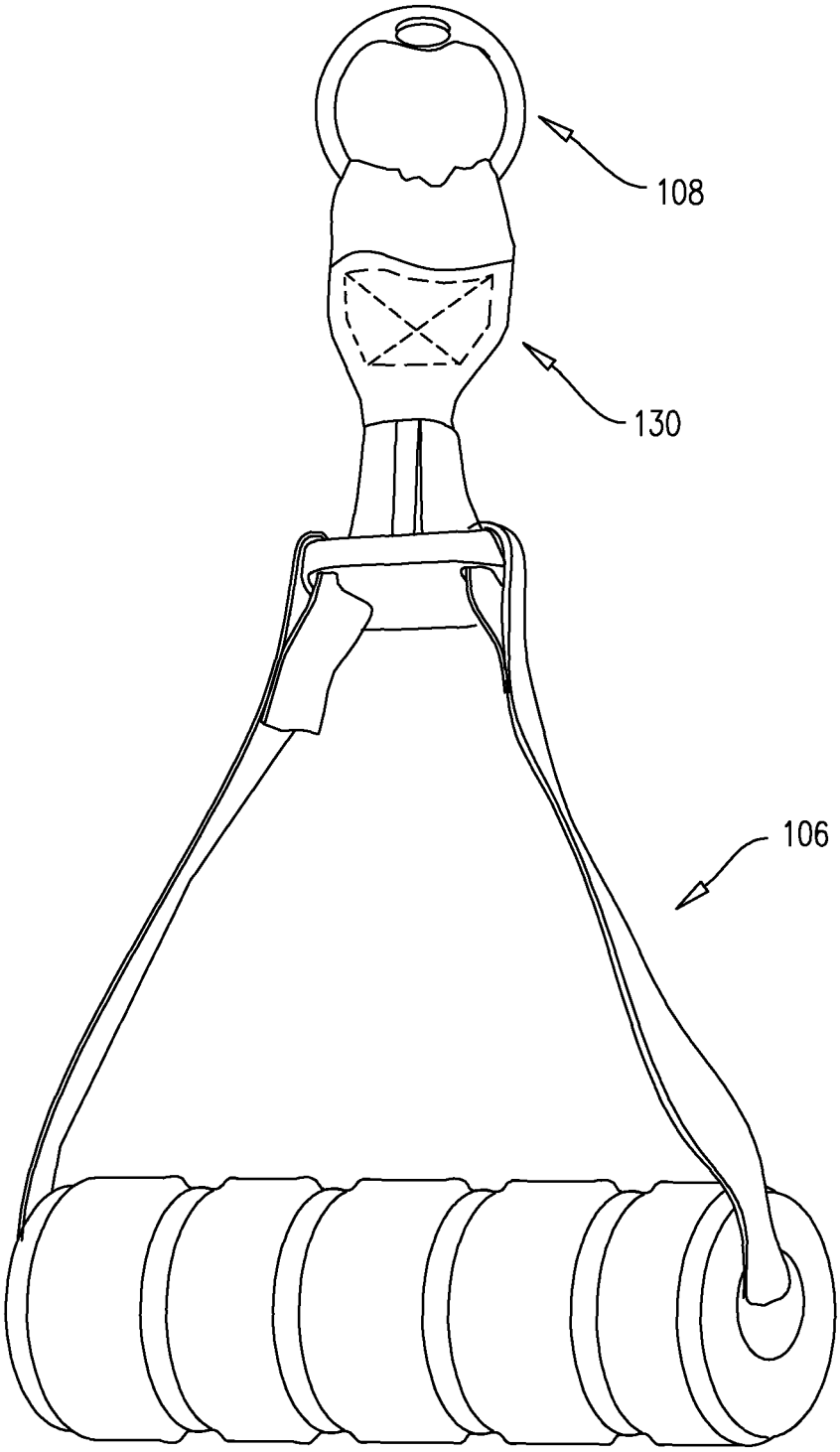

FIG. 1A illustrates an exerciser according to exemplary embodiments of the disclosed subject matter;

FIG. 1B schematically illustrates an exerciser according to exemplary embodiments of the disclosed subject matter;

FIG. 1C illustrates an elastic strap of the exerciser of FIGS. 1A and 1B, according to exemplary embodiments of the disclosed subject matter;

FIG. 2A schematically illustrates a perspective view of a tension buckle, according to exemplary embodiments of the disclosed subject matter;

FIG. 2B schematically illustrates a perspective view of the tension buckle of FIG. 2A with a schematic illustration of an elastic strap connected to and inserted in the tension buckle, according to exemplary embodiments of the disclosed subject matter; and FIG. 3 illustrates a safety member, according to exemplary embodiments of the disclosed subject matter.

DETAILED DESCRIPTION

For brevity and conciseness, in the context of the present disclosure a buckle implies a buckle as known in the art and/or any clasp and/or fastener and/or clip and/or a latch or any combination thereof suitable for releasably fastening and/or holding to another element as further described for a designated task or role.

In the context of the present disclosure, without limiting, a strap implies a generally flat elongated ribbon-like part having a width, a length with two longitudinal facing surfaces, and a thickness between the longitudinal facing surfaces and longitudinally opposite ends, wherein the width is smaller then the length and the thickness is negligible relative to either the length or the width.

In the context of the present disclosure, without limiting, in referencing to corresponding or correspondingly with respect to an element of a pair implies and/or applies pair-wise to each element of the pair.

Unless otherwise specified, the terms 'about' and/or 'close' with respect to a magnitude or a numerical value implies within an inclusive range of −10% to +10% of the respective magnitude or value.

The terms cited above denote also inflections and conjugates thereof.

One technical problem dealt by the disclosed subject matter is handily adjusting the elastic strap for a desired or a suitable resistance for personal exercise.

One technical solution according to the disclosed subject matter is a buckle mountable on the elastic strap and slidable and movable on the elastic strap, and further releasably pressable against and graspable on the strap to partition the strap to a working portion of a suitable length and a residual portion.

Thus, once the buckle is mounted on the strap the buckle may be maneuvered or slipped in a non-pressed state along the strap to a desirable or suitable position on the strap leaving a residual portion. As a complementary aspect, the strap is moved relative to the buckle. A buckle operable as described above is also denoted as a tension buckle.

Another technical problem dealt by the disclosed subject matter is preventing ripping and/or an abrupt tearing of a member connecting two elements under excessive or undue tension.

Another technical solution according to the disclosed subject matter is a member constructed for controllable and/or regulated gradual tearing made of and/or comprising constituents that successively and/or gradually rips or tears or releases.

In some embodiments, for example, the constituents, such as strings or wires, are constructed to have a range of tensile fatigue or breakdown within or below the allowed or designated tension so that responsive to an excessive tension the constituents gradually break down. In some other embodiments, for example, the member is made of woven fabric of thread or fibers so that as undue to excessive pressure is applied on the member some threads or fibers begin to tear while the rest are kept in the fabric, such as due to friction or intertwines, thus impeding the progress of tearing of the thread or fibers and slowing down the ripping of the member. The member operable as described above is also denoted as a safety member.

A potential technical effect of the disclosed subject matter is a personal exerciser comprising at least one elastic strap pullable by a person to apply a tension up to a certain extent thereon and having a linkage constructed for gradual tearing so that responsive to an excessive tension the member tears gradually thereby providing for safe operation and protecting against accidents as impingements of a snapped strap on the person.

A general non-limiting overview of practicing the present disclosure is presented below. The overview outlines exemplary practice of embodiments of the present disclosure, providing a constructive basis for variant and/or alternative and/or divergent embodiments, some of which are subsequently described.

FIG. 1A illustrates an exerciser 100 according to exemplary embodiments of the disclosed subject matter, and FIG. 1B schematically illustrates exerciser 100 according to exemplary embodiments of the disclosed subject matter.

Exerciser 100 comprises a pair of an elastic strap, the elastic strap denoted also as a strap 110. On each strap 110 is mounted a tension buckle, as described above, and denoted also as a buckle 120.

Strap 110 is connected at a first longitudinal end thereof to buckle 120 at an appendage of buckle 120 such by a screw or any fastener or method such as a rivet or an adhesive. The second longitudinal end of strap 110 opposite first longitudinal end thereof is inserted in buckle 120, and by pulling or tugging strap 110 in buckle 120 strap 110 is divided or partitioned by buckle 120 into a working potion denoted also as a working portion 140 and a residual portion generally formed as a loop and denoted also as loop 110.

Exerciser 100 further comprises a flexible member such as a sheet or a rope, denoted also as a coupling member 102, correspondingly connecting loop 104 of each of strap 110.

At corresponding second longitudinal ends of each of strap 110—longitudinally opposite first longitudinal ends—are correspondingly connected a pair of a safety member, such as described above, the safety member denoted also as safety member 130.

To each of safety member 130 are correspondingly connected a pair of a handle, denoted as a handle 106. Optionally, safety member 130 connects indirectly to each of handle 106 such as via a linkage, exemplified by the illustrated pair of a swivel buckle 108, wherein the linkage may be of any kind such as a sufficiently strong fabric or a pivotable metal shaft or a hook. Optionally or alternatively, safety member 130 connects directly to each of handle 106 such as by a fastener such as a rivet, a screw or any other fastener such as a clip or by glue.

Generally, coupling member 102 may be anchorable, e.g. anchored to a suitable support such as vertical post or an overhead rail. In some embodiments, coupling member 102 is anchored by wrapping at least partly around the support with suitable division or apportionment of exerciser 100 such as to practically equal parts. Optionally or alternatively, coupling member 102 comprises and/or attached to a hanger denoted as a hanger 112 and exemplified by a ring that represents any kind of a hanger such as a hook or a loop. Generally, hanger 112 is suitable for hanging exerciser 100 on a support while practically dividing exerciser 100 into equal parts. Optionally, hanger 112 is releasable and may be replaced by any element suitable for hanging or anchoring exerciser 100 to a suitable support.

In view of exerciser 100 illustrated in FIGS. 1A-1B, some further complementary elaborations and details are provided below.

FIG. 1C illustrates an elastic strap, such as strap 110, of exerciser 100, according to exemplary embodiments of the disclosed subject matter.

The elastic strap is made of an elastic material or one or more combinations and/or compositions of materials. For example, rubber in various forms including also vulcanized natural rubber, silicon, artificial polymers, woven elastic fibers and/or any combination or combinations thereof.

The elastic strap may be made to a variety of lengths and properties such as to adapt to various intended users such as adolescent, adults or elderly and/or disabled or injured persons.

The elastic strap may be stretched to various extents, the largest the extent the harder the resistance for further stretches, and vise versa. It is noted that generally the working portion such as working portion 140 is stretched to provide for exercising, though the residual portion such as loop 110 is simultaneously stretched and contributes to the exercising tension. Thus, unless otherwise noted, referring to tension of exerciser 100 implies tension of the working portion though the tension of the residual portion is not precluded.

On the elastic strap are marked indications, e.g. numbers or other symbols to indicate the extent of exercising stretches, enabling to track progress or plan exercising protocols, and/or to enable determining an adjusted length of each elastic strap. The numbers or symbols are marked such as by engraving, relief or otherwise such as by stamping or printing such as illustrated in a marking 142. Sliding the buckle along an elastic strap attached thereto enables adjusting a length of the elastic strap according to the marked indications.

In some embodiments, the elastic strap is constructed with provision for connecting members or elements at the ends thereof, for example, holes for connectors or fasteners.

Table-1 below includes some non-limiting illustrative exemplary properties of the elastic strap.

TABLE 1

| | |
|---|---|
| Length (cm) | 90-110 |
| Width (cm) | 3-5 |
| Thickness (mm) | 3-5 |
| Maximal stretching (%) of a relaxed length | 500-800 |
| Tearing strength (Kg/cm$^2$) | 100-250 |
| Hardness (Shore) | 35-55 |

It is noted that the values in Table-1 are not necessarily exact ones.

FIG. 2A schematically illustrates a perspective view of a tension buckle, such as buckle 120 exemplified hereinbelow, according to exemplary embodiments of the disclosed subject matter, Tension buckle 120 is constructed with a base or a frame, denoted also a frame 206, forming an opening therein denoted as a passage 204 through which a flexible strap, such as and exemplified by strap 110, may be passed or inserted. Passage 204 virtually or imaginarily forms a plane, the plane for clarity illustrated and represented as a projection 212 thereof with imaginary projection lines, each such line denoted as a projection line 214.

Passage 204 is formed with a length and a width, denoted also as a width 216 and a length 218, respectively, as illustrated in projection 212 of passage 204. For convenience and brevity, up and down directions are defined in and for tension buckle 120, the directions represented as an up direction 222 and a down direction 224, respectively, as illustrated with respect to passage 204 represented by projection 212 thereof, and likewise left and right directions are defined as represented, respectively, by a left direction 226 and a right direction 228. Width 216 is also denoted and indicated as PW.

Tension buckle 120 is further constructed with an appendage, denoted also as an appendage 208, generally having though not limited to a planar form. Appendage 208 is constructed or formed lengthwise to the right of frame 206 and oriented or inclined by an angle, denoted as an angle 202, relative to the plane of passage 204 as represented by projection 212.

Appendage 208 comprises and/or is formed with a structure and/or a facility for connection of strap 110, collectively denoted a connecting facility 232. For example, connecting facility 232 is formed as a hole for connection of strap 110 with a bolt or a screw or a rivet, or connecting facility 232 comprises a suitable surface for removably adhering strap 110 to appendage 208.

At the right of frame 206, lengthwise alongside the left side of appendage 208 is upwardly constructed a structure having a lengthwise rounded or an oval cross-section and/or a smoothly or a gradually varying upwardly increasing and downwardly decreasing surface. Said structure at the right of frame 206 is also referred to as a right flange.

In a similar manner, oppositely at the left of frame 206, lengthwise alongside of the left edge is downwardly constructed a structure having a lengthwise rounded or an oval cross-section and/or a smoothly or a gradually varying downwardly decreasing and upwardly increasing surface. Said structure at the left of frame 206 is also referred to as a left flange.

Each of the flanges has at least generally a height and a width, denoted and indicated respectively as LH and LW for the left flange and RH and RW for the right flange.

In some embodiments, the flanges are constructed such that RH=LH and RW=LW and/or RH=LW and RW=LH where the equalities are practical to a certain extent or tolerance rather than accurate.

FIG. 2B schematically illustrates a perspective view of the tension buckle 120 with a schematic illustration of strap 110 connected to and inserted in tension buckle 120, according to exemplary embodiments of the disclosed subject matter.

Strap 110 connects to buckle 120 by a fastener, denoted also as a fastener 296, that is collectively and exemplarily illustrated as a bolt that, by way of example, is inserted in connecting facility 232 formed as a hole.

From fastener 296 strap 110 continues until suitably inserted in passage 204 of buckle 120 over the right flange, thus forming loop 104 with a leftover portion thereof outside of buckle 120 where curves 292 denote any extent of loop 104.

Strap 110 continues in passage 204 of buckle 120 and exits passage 204 under the left flange, thus forming an S-like shape. Thus, when stretched, strap 110 adheres and/or affixed to buckle 120 sufficiently tightly practically without slipping or skidding.

Strap 110 continues to form the working portion, where an arrow 294 indicates any possible extent of the working portion.

Strap 110 generally has a uniform thickness that is denoted as ST and for convenience indicated also in FIG. 1C.

In some embodiments PW, or width 216 of passage 204 of buckle 120, is related to ST such as that PW is about the same size or extent as ST to allow movement of strap 110 in passages 204 while strap 110 is tight on buckle 120 to some degree at least. Thus, in some embodiments PW somewhat larger than ST, where in other embodiments PW somewhat smaller than ST and yet, in some embodiments, PW and ST are practically the same.

Accordingly, in some embodiments, buckle 120 is constructed such that LH=LW=RH=RW=PW=(ST±k) where k is a sufficiently small value indicating a spacing or margin between strap 110 and passage 204 and/or sufficiently small surplus of the width of strap 110 relative to passage 204 that still enable moving of strap 110 in passage 204 such as by some compression of strap 110. For example, k is between about −5 mm and about 5 mm, or, for example, k is between about −3 mm and about 3 mm, or, for example, k is between about −1 mm and about 1 mm.

The relations above are representative ones and are subject so some variations that do not disrupt overall associations between the values, and where the equalities are practical to a certain extent or tolerance rather than accurate.

The tension may be relieved and varied when the appendage is pulled off the surface of the elastic strap and/or when the elastic strap is bent or twisted thereby releasing the appendage from the elastic strap.

It is noted that in some embodiments the appendage as appendage 208 may have different shapes and forms constructed and/or adapted and/or configured to grasp or clasp the elastic strap as strap 110. Likewise, the appendage may be formed with different angular orientation to the frame, possibly according to the form or structure of the appendage.

Further, angle 202 or angular orientation of appendage 208 may range, for example, from about 45° to about 90°.

The tension buckle is generally made of suitably sturdy material to withstand the tensions and pressures, such as sufficiently strong plastic or steel.

In some embodiments other elements or members may be fitted to or constructed with appendage 208, for example, to obtain sufficient when using frail material.

FIG. 3 illustrates a safety member, such as safety member 130, according to exemplary embodiments of the disclosed subject matter.

In the exemplary illustrated embodiment the safety member is constructed as a woven fabric of strands where the fabric and/or strands are formed or selected to successively and/or gradually rip once the applied pressure thereon begins to exceed or fall within an allowed range of about 20% to about 30% of a sufficiently high designated pressure and/or a sufficiently high obtained pressure of and/or on the exerciser. The sufficiently high pressure may be calculated or at least statistically measured or otherwise obtained such as derived from other measurements possibly of different exercisers.

The safety member is designed and constructed such that when the pressure thereon is such that the safety member breaks or rips the flexible strap is thrown or tossed away from corresponding handle 106 thus from an operator of the exerciser.

FIG. 3 further illustrates a more detailed exemplary swivel buckle 108 and exemplary handle 106 relative to FIG. 1.

Generally the exerciser is attached to or wrapped over a suitably firm or rigid support, and the handles are pulled to work against the tension of the elastic straps. The exerciser such as exerciser 100 is flexible enough to allow pulling by hands, legs or other parts of the body such as the shoulders and/or the hips, possibly with amendments such as the different handles or substitutes thereof for connect or fixing to the exercised part of the body. The effort of exercising may be varied by adjusting the tensions of the elastic straps and/or by changing the elastic straps for ones with different lengths and/or of appropriate properties The exerciser, such as exerciser 100, and/or parts thereof were described as non-limiting examples, and may be subject to some variations.

For example, the strap may be of a non-flat form such as round or elliptical or any suitable form or cross-section, including, optionally, a variable cross-section.

In some embodiments, the exerciser may not be formed as a pair but rather as a half of the exerciser, optionally devoid of a coupling member, as exemplified by and in a dashed-dotted frame 144 in FIG. 1B.

Further, although the exerciser is designed and constructed with an intention of personal exercising by pulling thereon, the exerciser may be used for other purposes possibly with some modifications, for example, for lifting weights or wounded legs.

As another exemplary variation, a safety member such as safety member 130 may be connected at first longitudinal ends of each of strap 110 closer to coupling member 102 rather than at the second longitudinal ends of each of strap 110 nearer to each of handle 106.

There is thus provided according to the present disclosure an exercising apparatus, comprising a pair of elastic straps correspondingly having lengths, and a pair of buckles correspondingly mounted on the pair of the elastic straps, where each of the buckles having a frame with a passage for each of the elastic straps and oppositely directed flanges and an appendage connect and inclined to the frame on which a first longitudinal end of each of the elastic straps is attached thus compelling each of the elastic straps to form S-shape over and in each of the buckles, consequently longitudinally partitioning each of the elastic straps by sliding each of the buckles along each of the elastic straps to releasably fasten each of the buckles on each of the elastic straps.

In some embodiments, the apparatus further comprises a pair of safety members correspondingly linked to the pair of the elastic straps at a second longitudinal end of each of the elastic straps, and constructed for a gradual tearing responsive a pressure above a sufficiently high pressure.

In some embodiments, the sufficiently high pressure is about 20% to about 30% of a sufficiently high designated pressure.

In some embodiments the sufficiently high pressure is about 20% to about 30% of a sufficiently high obtained pressure.

In some embodiments, the safety members are constructed as a woven fabric of strands and formed to successively and gradually rip responsive the pressure above the sufficiently high pressure.

In some embodiments, the elastic straps are made of any one of: natural rubber vulcanized natural rubber, silicon, artificial polymers, woven elastic fibers or any combination thereof.

In some embodiments, the elastic straps are stretchable up to a range of about 500% to about 800% relative to the lengths of the elastic straps in a relaxed non-stretched form thereof.

In some embodiments, the elastic straps have tearing strength in a range of about 100 to about 250 $Kg/cm^2$.

In some embodiments, the flanges of the buckles have a rounded cross-section in a view along the connation of the appendage to the frame.

In some embodiments, the flanges of the buckles have a height and a width of practically the same size.

In some embodiments, the flanges of the buckles have a height and a width of practically the same size and the passage is of a width to some extent less of said same size to allow movement of each of the elastic straps in each passage.

In some embodiments, the appendage is inclined to the frame in a range of about 45 degrees to about 90 degrees.

In some embodiments the apparatus comprising one symmetrical half thereof.

In the context of some embodiments of the present disclosure, by way of example and without limiting, terms such as 'operating' or 'executing' imply also capabilities, such as 'operable' or 'executable', respectively.

Conjugated terms such as, by way of example, 'a thing property' implies a property of the thing, unless otherwise clearly evident from the context thereof.

The corresponding structures, materials, acts, and equivalents of all means or step plus function elements in the claims below are intended to include any structure, material, or act for performing the function in combination with other claimed elements as specifically claimed. As used herein, the singular forms "a", "an" and "the" are intended to include the plural forms as well, unless the context clearly indicates otherwise. It will be further understood that the terms "comprises" and/or "comprising" and/or "having" when used in this specification, specify the presence of stated features, integers, steps, operations, elements, and/or components, but do not preclude the presence or addition of one or more other features, integers, steps, operations, elements, components, and/or groups thereof.

As used herein the term "configuring" and/or 'adapting' for an objective, or a variation thereof, implies using materials and/or components in a manner designed for and/or implemented and/or operable or operative to achieve the objective.

When a range of values is recited, it is merely for convenience or brevity and includes all the possible subranges as well as individual numerical values within and about the boundary of that range. Any numeric value, unless otherwise specified, includes also practical close values enabling an embodiment or a method, and integral values do not exclude fractional values. A sub-range values and practical close values should be considered as specifically disclosed values.

The terminology used herein should not be understood as limiting, unless otherwise specified, and is for the purpose of describing particular embodiments only and is not intended to be limiting of the disclosed subject matter. While certain embodiments of the disclosed subject matter have been illustrated and described, it will be clear that the disclosure is not limited to the embodiments described herein. Numerous modifications, changes, variations, substitutions and equivalents are not precluded.

The invention claimed is:

1. An exercising apparatus, comprising:

a pair of elastic straps correspondingly having lengths; and a pair of buckles correspondingly mounted on the pair of the elastic straps, where each of the buckles is mounted on an elastic strap of the pair of elastic straps;

wherein each buckle of the buckles comprises:

a flange comprising a planar frame and a passage in the planar frame;

an appendage comprising a planar form inclined in an orientation with a predetermined angle relative to the planar frame of the flange and a fastener to couple the elastic strap to the buckle; and, wherein the corresponding elastic strap is inserted through the passage from a fist side of the flange and exit the passage from a second side of the flange and forming a loop by passing over the appendage, wherein the appendage prevents slipping of the elastic strap through the passage when the strap is pulled away from the flange at a distal end of the strap.

2. The apparatus according to claim 1, further comprising a pair of safety members correspondingly linked to the pair of the elastic straps at a second longitudinal end of each of the elastic straps, and constructed for a gradual tearing responsive to an applied pressure.

3. The apparatus according to claim 1, wherein the elastic straps are made of any one of: natural rubber, vulcanized natural rubber, silicon, artificial polymers, woven elastic fibers or any combination thereof.

4. The apparatus according to claim 1, wherein the elastic straps are stretchable up to a range of about 500% to about 800% relative to the lengths of the elastic straps in a relaxed non-stretched form thereof.

5. The apparatus according to claim 1, wherein the elastic straps have tearing strength in a range of about 100 to about 250 $Kg/cm^2$.

6. The apparatus according to claim 1, wherein the flanges of the buckles have a rounded cross-section in a view along a connection of the appendage to the frame.

7. The apparatus according to claim 1, wherein the flanges of the buckles have a height and a width of practically the same size.

8. The apparatus according to claim 1, wherein the flanges of the buckles have a height and a width of practically the same size and the passage is of a width to some extent less of said same size to allow movement of each of the elastic straps in each passage.

9. The apparatus according to claim 1, wherein the appendage is inclined to the frame in a range of about 45 degrees to about 90 degrees.

10. The apparatus according to claim 1, comprising one symmetrical half thereof.

11. The apparatus of claim 1, further comprising:

two handles, each handle connected to a corresponding safety member; and an anchorable flexible coupling member correspondingly connecting a loop of each elastic strap; and, wherein each of the elastic straps comprises marked indications to enable determining an adjusted length of each elastic strap.

* * * * *